United States Patent [19]

Blandin

[11] Patent Number: 4,854,887

[45] Date of Patent: Aug. 8, 1989

[54] PIPE SYSTEM FOR CENTRAL SUCTION CLEANING INSTALLATION

[75] Inventor: Jean-Claude Blandin, Cholet, France

[73] Assignee: S.A. Raccords et Plastiques Nicoll, Cholet, France

[21] Appl. No.: 93,485

[22] Filed: Sep. 4, 1987

[30] Foreign Application Priority Data

Sep. 12, 1986 [FR] France ..... 86 12748
May 21, 1987 [FR] France ..... 87 07110

[51] Int. Cl.[4] ..... H01R 4/64
[52] U.S. Cl. ..... 439/194; 174/47
[58] Field of Search ..... 439/190, 191, 192, 194, 439/204; 174/47; 285/7; 200/61.6; 15/314

[56] References Cited

U.S. PATENT DOCUMENTS 3,258,553 6/1966 Breslin ..... 200/51
3,387,319 6/1968 Ferraris et al. ..... 439/194
3,465,111 9/1969 Breslin ..... 200/61.6
3,546,656 12/1970 Pritulsky ..... 439/191
3,914,002 10/1975 Berliner et al. ..... 174/47
4,473,923 10/1984 Neroni et al. ..... 15/377

FOREIGN PATENT DOCUMENTS 0159307 10/1985 European Pat. Off. .
2832547 2/1980 Fed. Rep. of Germany ..... 174/47
2309190 11/1976 France .
1160805 8/1969 United Kingdom ..... 174/47

*Primary Examiner*—Neil Abrams
*Attorney, Agent, or Firm*—Pearne, Gordon, McCoy & Granger

[57] ABSTRACT

In known manner, a pipe system comprises a group of tubes and couplings connecting a suction station to one or more suction openings, the tubes and couplings being equipped with low voltage electric conductors for transmitting an electric stop or start signal from the station. According to the invention, the conductors equipping the tubes are in the form of strips integral with the tubes. Such strips can also equip the couplings.

10 Claims, 9 Drawing Sheets

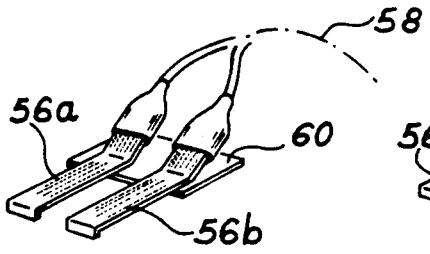
FIG. 10a
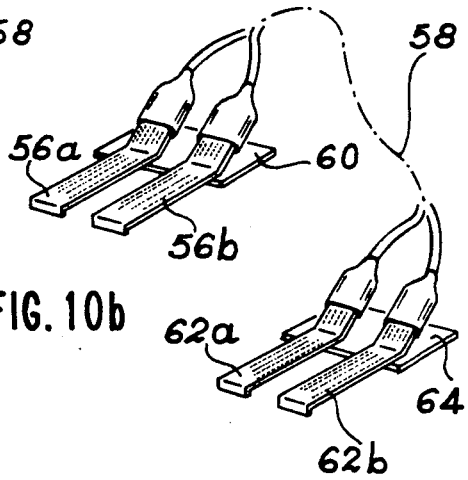
FIG. 10b
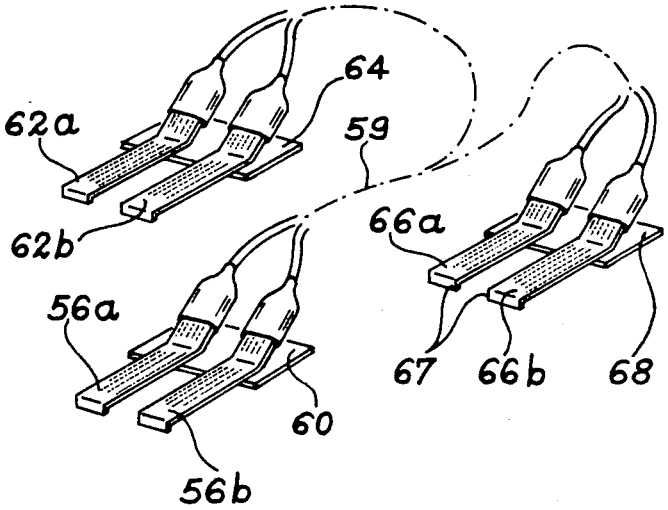
FIG. 10c
FIG. 11
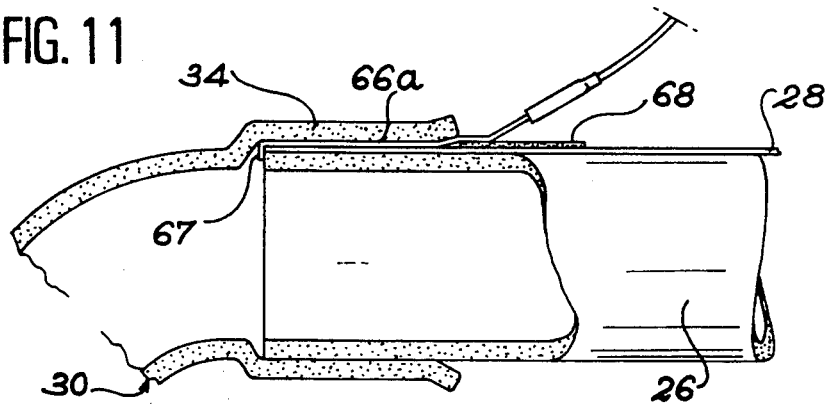

FIG. 15a
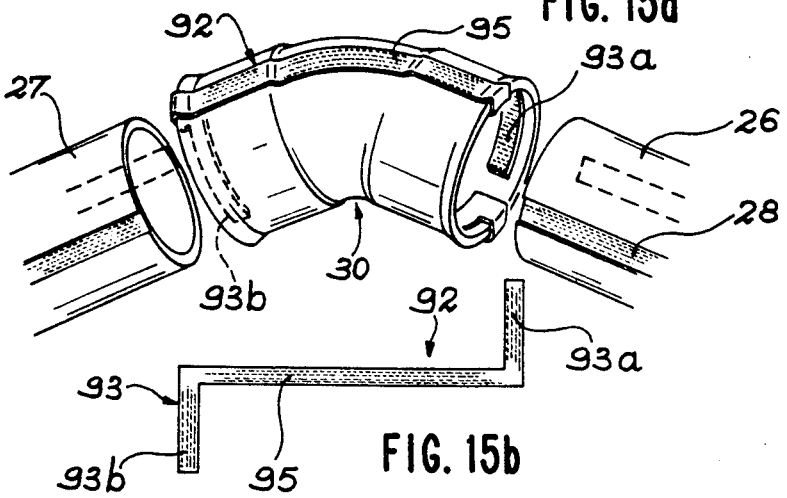
FIG. 15b
FIG. 16a
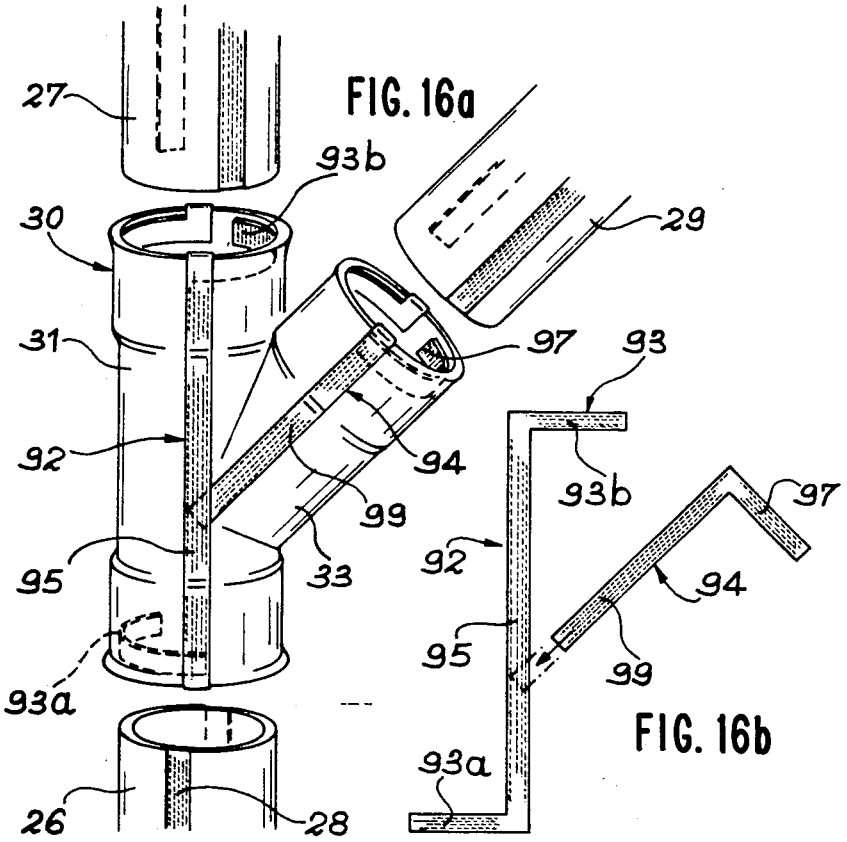
FIG. 16b

PIPE SYSTEM FOR CENTRAL SUCTION CLEANING INSTALLATION

BACKGROUND OF THE INVENTION

The present invention relates to a pipe system of a suction central cleaning installation and more particularly to the ducts located between a suction station and the suction or exhaust openings located in the different rooms of a building. These ducts can be fixed to the walls or floors of the rooms of the building. The mobile and visible part of the cleaning installation can be connected, as desired, to any one of the said suction openings. Thus, during the cleaning operation, apart from the means constituted by the conventional suction hose having a flexible part and a rigid part for gripping, there is only a need for appropriate end fittings for connecting the tube into the suction opening. Each opening is provided with a sealing device and is equipped with an incorporated contactor electrically connected to the motor of the suction turbine, so that by simply introducing or withdrawing the suction hose, said turbine is electrically stopped or started.

For such installations, which presupposes the presence of an electrical control of the suction group at each opening located in the different rooms of the building, it is necessary to connect the individual electrical controls to the suction station by an electric cable. For safety reasons, preferably use is made of low voltage cables (24 v). However, during the installation of the suction system, this makes it necessary to pass into the walls or floors of the building central electrical wiring and each opening must be individually connected thereto. Such an operation is fastidious and onerous, because it requires specially trained personnel on site.

The attached FIG. 1, seen in cross-section, shows a building 10 (e.g. a detached house) equipped with such a central suction cleaning system. The latter comprises a suction station 12 connected by a certain number of tubes 14 to openings 16. There is an opening 16 in each room. Thus, when it is wished to clean a room by suction, it is no longer necessary to drag or haul a heavy, cumbersome suction or exhaust fan. It is merely necessary to open the cover closing opening 16 located in the corresponding room and to connect a flexible tube to said opening. The means 18 to be manipulated is a conventional suction hose having a rigid part 20 for gripping and a flexible part 22, whereof the end opposite to the rigid part 20 is introduced into the opening 16 with the aid of an appropriate end fitting 24. In order to simplify the installation of the electric wiring, it has been proposed to pass the conductors along tubes and couplings.

U.S. Pat. No. 3,465,111 describes such a system in which the cables are in the form of small diameter unifilar conductors. The couplings comprise a female part having a certain number of conductive material plates. In order to bring about connection, the insulant on the conductors at the end of a tube is torn away and the end thereof is introduced into the coupling in order that the bared or stripped part of the conductors comes into contact with the plates.

Although this solution makes it possible to reduce the overall dimensions of the installation by passing the conductors along tubes, it still suffers from a certain number of disadvantages. The realization of such a system is complex and consequently costly. Moreover, stripping is a difficult operation and the contact between the stripped conductor and the plates of the couplings is not reliable, because there is little surface in contact. Finally, the housing of the conductors leads to the formation of a protuberance within the tubes and said protuberance is subject to abrasion by foreign bodies sucked into the installation.

SUMMARY OF THE INVENTION

The present invention aims at obviating these disadvantages by proposing a pipe system for a central suction cleaning installation, which is simple and therefore relatively inexpensive, whilst ensuring a good protection of the conductors and a good electric contact at the couplings.

The pipe system according to the invention, which serves to connect a suction or exhaust station to at least one suction or exhaust opening, in per se known manner comprises at least one tube equipped with at least one electric conductor for the transmission of an electric control signal from the suction station. According to the invention, said electric conductor is in the form of a thin strip made from an electrically conductive material and which is integral with the tube.

When used in the present description, the term "thin strip" designates a band of conductive material deposited on the tube and which has a relatively large width (a few millimeters and which can extend up to 10 or 15 mm) and a very small thickness compared with its width (a fraction of a millimeter or even much less). The expression "integral with the tube" means that the thin strip is fixed to the tube by one of its faces using any appropriate means, e.g. bonding or is deposited by a method preventing any separation between strip and tube. Thus, a thin conductive band e.g. constituted by a metallization, conductive paint, conductive varnish, a metallized film, etc. can be looked upon as a thin strip integral with the tube.

Preferably, the tube is made from a plastic material, such as PVC, whilst the strip is metallic and is preferably of aluminum.

Optionally, the face of the thin strip not in contact with one wall of the tube can be coated with a protective layer of an electrically insulating material.

According to another aspect of the pipe system according to the invention, the latter also comprises at least one coupling having at least one cylindrical portion or socket having dimensions enabling the tube and said cylindrical portion or socket to be introduced into one another and electrical connection means between the thin strip and another part of the installation.

According to a first embodiment, said electrical connection means comprise a conductive band extending over part of the periphery of said cylindrical portion or socket, the arrangement of the thin strip and the conductive band being such that by introduction of the tube and said cylindrical portion into one another, the strip can be made to face the conductive band and is located at a small or zero distance therefrom and a conductor which can be electrically connected on the one hand to the conductive band and on the other to said other part of the installation.

In the preferred embodiment, the thin strip or strips are located on an outer surface of the tubes and the conductive band or bands on the internal face of the socket of the coupling. In this case, the tube is introduced into the socket. However, it would not pass outside the scope of the invention to place the strips on the internal face of the tube and the conductive bands on the external face of the socket. In this case, the socket is introduced into the tube.

Preferably, the conductive band placed on the cylindrical portion or socket is in the form of a thin strip integral with said coupling. In this case, it can be in the form of a metal band, conductive paint, conductive varnish, a metallization, etc. In another embodiment it can be in the form of a plastic-conductor complex, i.e. a conductive material deposited on a plastic material band, the latter then being deformed in order to obtain a cylindrical shape and which can be fixed to said cylindrical portion or socket. In the latter case, the conductive band can be in the form of a thin metal band, a conductive paint, a conductive varnish, a metallization, etc.

Preferably, the conductor is also in the form of a thin strip integral with the coupling and having one end in contact with the conductive band.

In this case, the conductive band can be made in one piece with the conductor from a precut conductive band and fixed to the coupling. In other embodiments, the conductor can be in the form of a unifilar conductor which is or is not independent of the coupling, a conductive paint, conductive varnish, metallization, etc. As stated hereinbefore, it can also be in the form of a plastic-conductor complex, the conductive materials being deposited on a plastic support, which is then fixed to the coupling.

The electrical connection between the strips of the tube and the conductive bands provided on the coupling can be formed in two ways. In the first case, the dimensions of the tube and the cylindrical portion are such that by simply fitting together or nesting said two parts, the strip can be brought into direct contact with the conductive band. In a second case, the system also has a tongue of electrically conductive material which can be forcibly introduced between the thin strip and the conductive band in order to ensure electric contact between said two elements when the tube and the cylindrical portion of the coupling are fitted into one another.

In another construction, the electrical connection means between the thin strip and another part of the installation comprise a tongue of an electrically conductive material, which can be forcibly introduced between the tube and the cylindrical portion of the coupling when these elements are fitted into one another, so as to be in contact with said thin strip and a conductor which can be electrically connected on the one hand to said tongue and on the other to said other part of the installation.

Optionally, said tongue has an end with a folded or bent part, which can bear against a terminal edge of the tube or said cylindrical portion of the coupling.

In a final construction, the electrical connection means between the thin strip and another part of the installation comprise a staple or jumper able to overlap a terminal edge of the tube or said cylindrical portion of the coupling, a portion of said staple or jumper being contactable with the thin strip when the tube and cylindrical portion are fitted into one another and a conductor, which can be electrically connected on the one hand to said staple or jumper and on the other to said other part of the installation.

The invention also relates to a process for producing a tube of the type described hereinbefore, i.e. with conductors in the form of thin strips integral with the tube. In this process the tube is produced by extrusion by passing a tube blank between a die and a mandrel. According to the invention this process comprises the stages of (a) introducing part of a thin strip between the die and the tube level with the die outlet, in such a way that one face of said strip is in contact with the tube and a pressure applying the strip to the tube is exerted and (b) simultaneously moving the tube and the strip during the extrusion stage, said movement progressively bringing about the at least partial adhesion of the strip to the tube by means of said pressure.

Optionally, it is possible to bring about a heating of the strip before it comes into contact with the tube, so as to facilitate bonding stage (c). Preferably, said heating is brought about by passing the strip along a thin slit made in the groove and in which it can slide without friction. Finally, it can be advantageous to provide a supplementary stage (d), performed before stage (c) and which consists of depositing an attachment layer on the face of the strip to come into contact with the tube. The function of said attachment layer will be explained hereinafter.

Finally and preferably, the process also comprises the following stages performed after stage (b):

(e) passing the tube, following its exit from the die, into a tube gauge having a cylindrical orifice, whose internal diameter is equal to the nominal diameter of the finished tube, the inner face of said cylindrical orifice having a certain number of pockets or cavities and (f) placing the latter under vacuum, so that by engaging the tube against said cylindrical orifice, on the one hand the tube is brought to the desired diameter and on the other the strip is definitively sealed with the tube.

BRIEF DESCRIPTION OF THE DRAWINGS

The invention is described in greater detail hereinafter relative to non-limitative embodiments and the attached drawings, wherein show:

FIGS. 10*a* to 10*c* diagrammatic perspective views illustrating different possible arrangements for the tongues used in the device of FIG. 9.

FIG. 11 a part sectional diagrammatic view showing how the tongues used in the arrangement of FIGS. 9 and 10 are placed between the tube and the coupling.

FIGS. 15(*a* and *b*) and 16(*a* and *b*) diagrammatic perspective views showing how the conductive band and the conductor of a coupling can be produced in one piece from a precut conductive band.

DETAILED DESCRIPTION OF PREFERRED EMBODIMENTS

Figure 1:
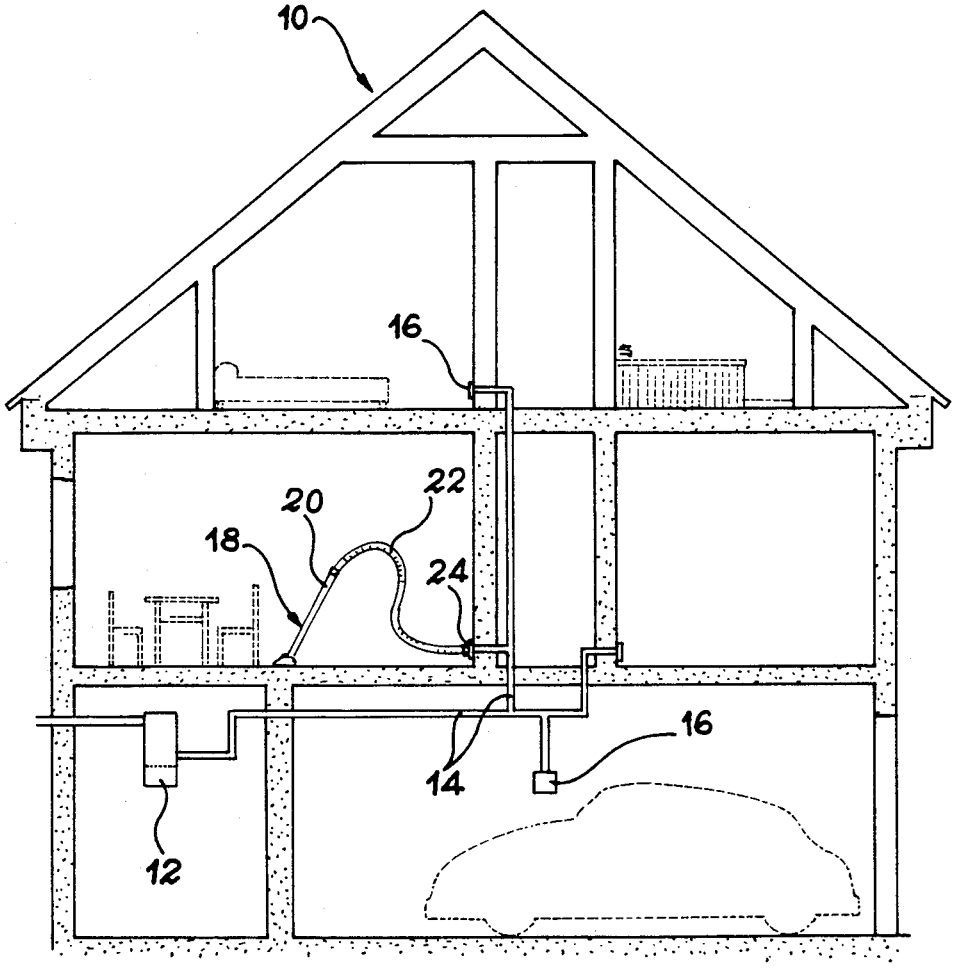
FIG. 1 a diagrammatic sectional view of a building equipped with a central suction cleaning system.
Figure 2A:
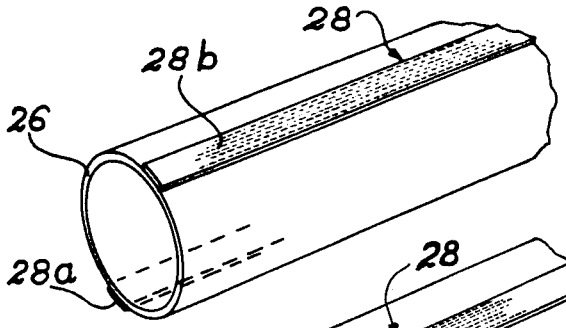
FIGS. 2*a* and 2*b* a diagrammatic perspective views showing two possible arrangements of thin strips on the tubes according to the invention.
Figure 2B:
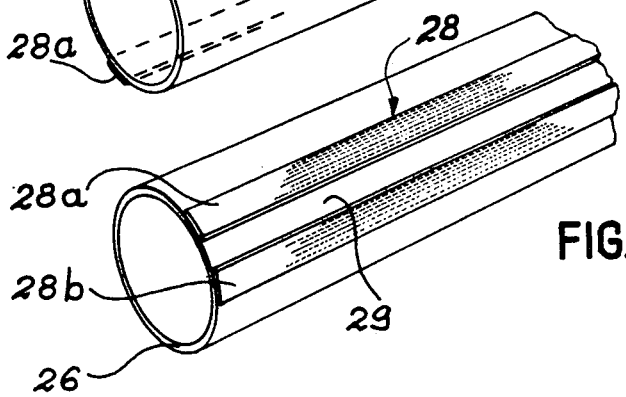

On referring to FIGS. 2*a* and 2*b*, it can be seen that a tube 26 according to the invention is equipped with two conductors for the transmission of low voltage control current from the suction or exhaust station.

According to the invention, these conductors are in the form of thin strips 28 integral with the tube. In the case illustrated here and which is the general case, there are two conductors 28*a*, 28*b* of this type on each tube. Thus, the construction of the centralized suction system is such that the opening of the cover covering a suction opening and the introduction of an end fitting into it brings about the closing of a circuit incorporating these two conductors, which starts up the suction station. It is obvious that the two conductor strips 28*a* and 28*b* must be electrically insulated from one another.

FIGS. 2*a* and 2*b* shows that they are positioned along the generatrixes of the tube and on the outer face thereof. This forms the most practical solution, but it would not pass outside the scope of the invention to use another arrangement, e.g. with strips on the inner face of the tube or strips not arranged in accordance with the generatrixes. The width of the strips 28 is small compared with the circumference of the tube (e.g. approximately 10 mm wide for a tube having a diameter of approximately 5 cm).

In the case of FIG. 2*a*, strips 28*a*, 28*b* are arranged in accordance with diametrically opposite tube generatrixes and in the case of FIG. 2*b* they are located along adjacent generatrixes, but which are separated from one another by a space 29, so that they are kept electrically insulated from one another. In this case, the width of space 29 is substantially equal to the width of the actual strips.

It should be noted that for the clarity of the drawing, the thickness of the strips 28 compared with that of tube 26 has been exaggerated in FIG. 2 and certain other drawings. In reality, the thickness of the tube is approximately 1 or a few mm, whilst that of the strips is approximately 1/10 mm, in the case of a metal strip, or even less in the case of a conductive varnish or paint, or a metallization.

Figure 3:
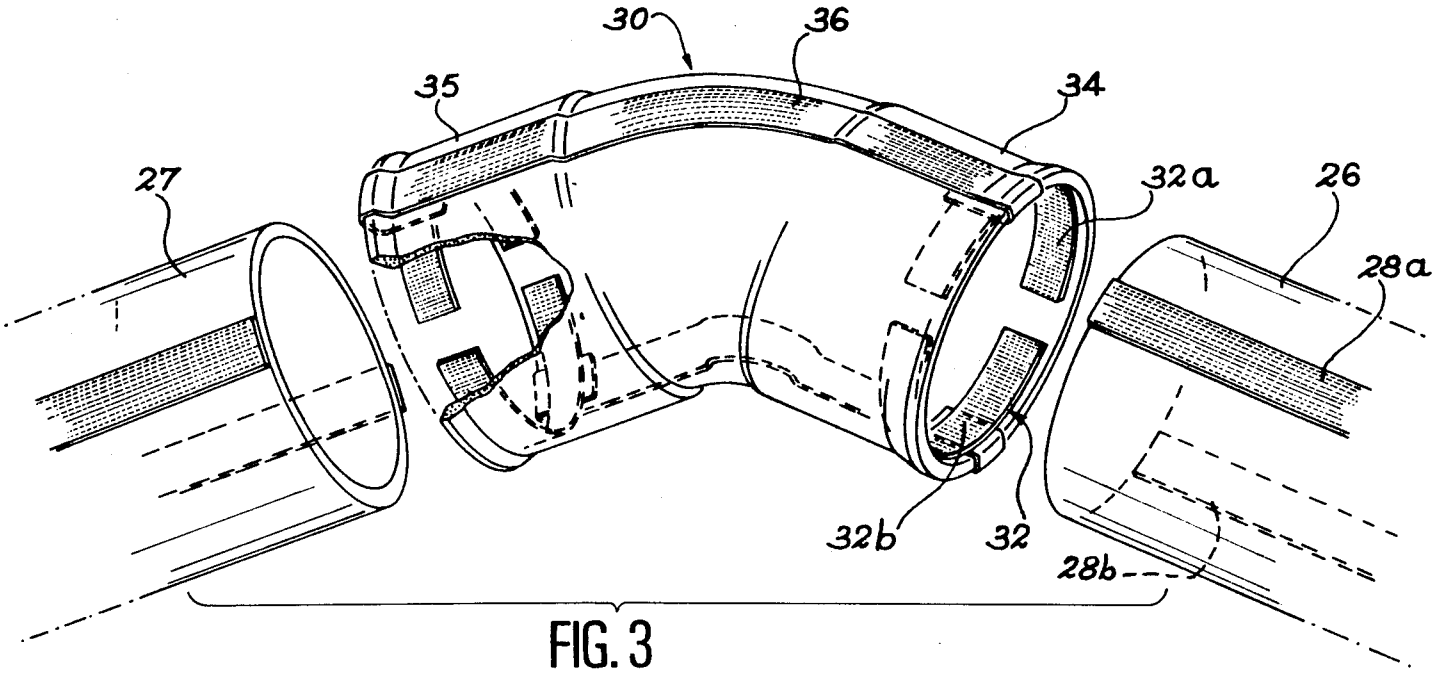
FIG. 3 a diagrammatic perspective view showing how the tubes according to the invention can be connected to a coupling, which is itself equipped with a thin strip integral therewith.

FIG. 3 shows how such tubes can be introduced into couplings used in a central suction cleaning installation pipe system according to the invention. Thus, the presence of such couplings is necessary, because it is never possible to have a single rectilinear tube between the suction station and an opening located in a room in the building. It is necessary to have bends or couplings permitting branches, so as to be able to serve all the openings in the building. The material from which the couplings is made can be the same as that of the tubes and in particular a plastic material, such as PVC.

FIG. 3 shows two tubes 26, 27, whereof the axes are not aligned and which are interconnected by means of a coupling 30 forming an elbow.

The latter has, at each of its ends, hollow cylindrical portions or sockets 34, 35. Within socket 34 are located two conductive bands 32, whereof each extends over part of the periphery of socket 34. Each of these bands 32*a*, 32*b* extends over virtually half the periphery, but these two bands are electrically insulated from one another. The internal diameter of the socket 34 of coupling 30 is substantially equal or slightly larger than the external diameter of tube 26, so that the latter can penetrate the socket. The dimensions are such that under the effect of said fitting operation, each of the strips 28*a*, 28*b* comes into contact with one of the bands 32*a*, 32*b* respectively. Each of these bands, e.g. 32*a*, is electrically connected to a conductor in the form of a thin strip 36 located on the outer face of coupling 30 and integral therewith. Strip 36 can be deposited on coupling 30 by any random method usable for depositing strips 28 on tube 26. At the other end of coupling 30, i.e. level with socket 35, strip 36 is in electric contact with another conductive band arranged in the same way as band 32*a*. The introduction of tube 27 into socket 35 takes place in the same way as tube 26 into socket 34.

Figure 4:
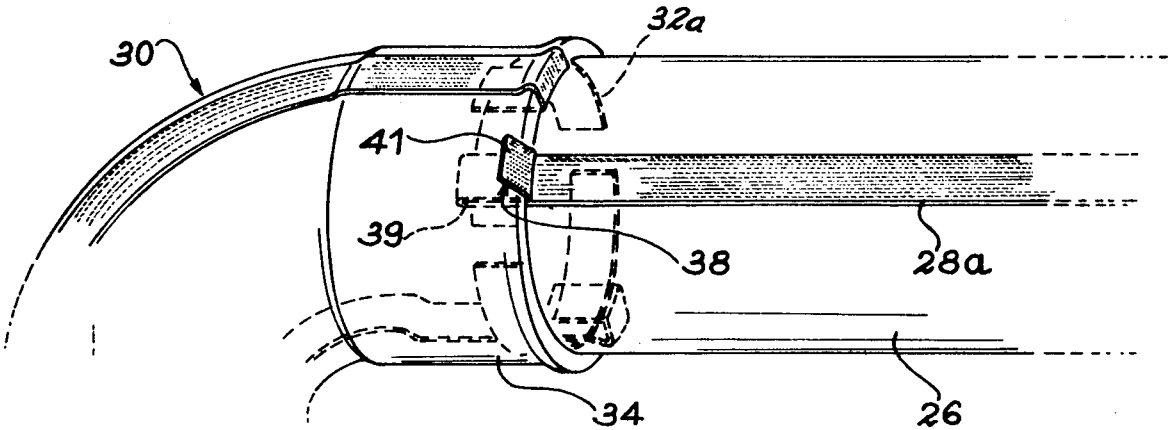
FIG. 4 a diagrammatic perspective view showing how it is possible to introduce a thin tongue between the strip of a tube and a conductive band provided on a coupling.

In the case of FIG. 3, the dimensions of the tube and the coupling are such that by simply fitting the tube into the coupling, the tube strips 28 come into contact with bands 32*a*, 32*b*, thus ensuring the electrical continuity of the assembly. However, in another embodiment illustrated in FIG. 4, it is possible to place a metal tongue 38 between the tube and the coupling, said tongue exerting pressure on the one hand on one of the strips 28 and on the other on one of the bands 32. This improves the electric contact and makes it more reliable.

Figure 6:
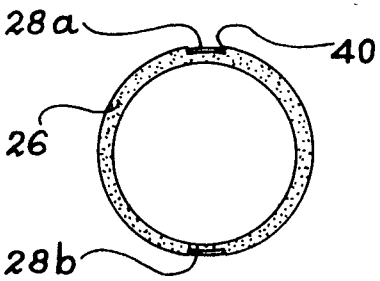
FIG. 6 a diagrammatic sectional view showing how the strip can be fitted into a small depth groove provided on the tube surface.
Figure 5:
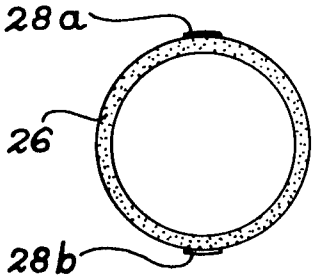
FIG. 5 a diagrammatic sectional view showing how the strip can be deposited by bringing about a slight projection over the outer wall of the tube.

In this case, it is preferable for the strip in question, e.g. 28*a*, to be located in a limited depth groove made on the tube surface. The different possible arrangements of the strips are illustrated in the sectional views of FIGS. 5 and 6. FIG. 5 shows that the thin strips 28*a*, 28*b* which, in the particular case, are diametrically opposite, are deposited on the surface of the tube without any prior machining of the latter and despite their very limited thickness project with respect to said surface. This arrangement ensures electric contact when the tube is forcibly introduced into the coupling. It is possible to see in FIG. 6 that the strips 28*a*, 28*b* are slightly embedded, i. e. are located in limited depth grooves 40 made as from the surface of the tube. This arrangement facilitates introduction and in particular the positioning of tongue 38 of FIG. 4. The latter can have a first part 39 in contact with strip 28*a* and conductive band 32*a* and a bent part 41 forming a certain angle with part 39 and bearing on the edge or rim of socket 34. The presence of the bent part 41 facilitates manipulation and the putting into place of tongue 38.

A description will now be given of other embodiments of couplings and the electrical connection between the tubes and the other parts of the installation with reference to FIGS. 7 to 12.

Figure 7:
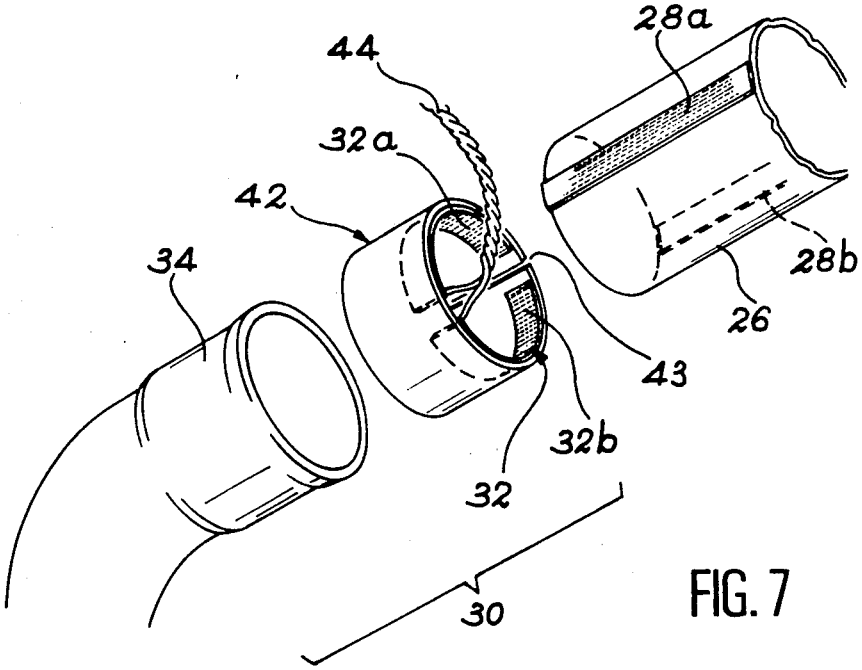
FIG. 7 a perspective diagrammatic view showing another embodiment of a coupling usable in the invention.

In the case of FIG. 7, coupling 30 still has a cylindrical portion or socket 34. However, the conductive bands 32 are no longer placed directly on the inner surface of cylindrical part 34 and are instead located on the inner surface of a spacer ring 42 which is to be introduced into socket 34. In this variant, the conductive bands 32*a*, 32*b* are connected to another part of the installation (e.g. another tube, another part of the same coupling or the suction station) by unifilar conductors 44. The spacer ring 42 is shaped from a flat plate on which are deposited the conductive bands, as illustrated in FIGS. 8*a* to 8*c*.

Figure 8A:
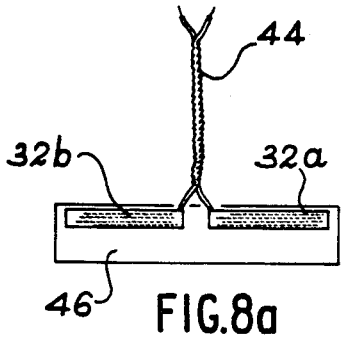
FIGS. 8*a* to 8*c* diagrammatic views illustrating different embodiments of spacers on which are deposited the conductive bands used in couplings such as the one illustrated in FIG. 7.

FIG. 8*a* shows an elongated plate 46 on which have been deposited the two bands 32*a*, 32*b*, which are electrically connected to conductors 44. The deformation of plate 46 will lead to a ring 42 having a longitudinal slit 43, as illustrated in FIG. 7. In the case of FIG. 8*a*, there is only one plate 46 equipped with two bands 32*a*, 32*b* connected to a conductor 44. Such an arrangement is e.g. used for connecting a suction opening to the final coupling or the suction station control to the first coupling.

Figure 8B:
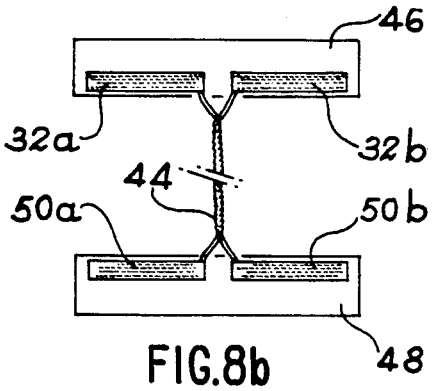

In the case of FIG. 8*b*, there are two plates 46, 48 carrying conductive bands 32*a*, 32*b* and 50*a*, 50*b* respectively. In this case, band 32*a* is connected by one of the conductors 44 to band 50*a*, whilst band 32*b* is connected by the other of said conductors 44 to band 50*b*. This arrangement is used for a coupling with two sockets and which is e.g. used for producing an elbow or a junction between two consecutive tubes.

Figure 8C:
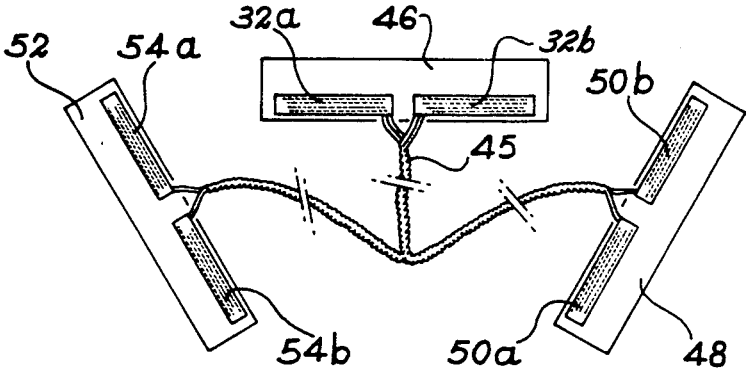

In the case of FIG. 8*c*, there are three plates 46, 48 and 52, each carrying an assembly of two conductive bands, namely bands 32*a*, 32*b* on plate 46, bands 50*a*, 50*b* on plate 48 and bands 54*a*, 54*b* on plate 52. In this construction, conductors 45 differ slightly compared with conductors 44 of FIGS. 8*a* and 8*b*. There are in fact more conductors, so that each of the bands of plate 46 is electrically connected to a band of plate 48 and a band of plate 52. This arrangement with three sockets makes it possible to produce branches, e.g. for connecting the main duct on the one hand to another tube and on the other to a suction opening, or to two different suction openings.

Figure 9:
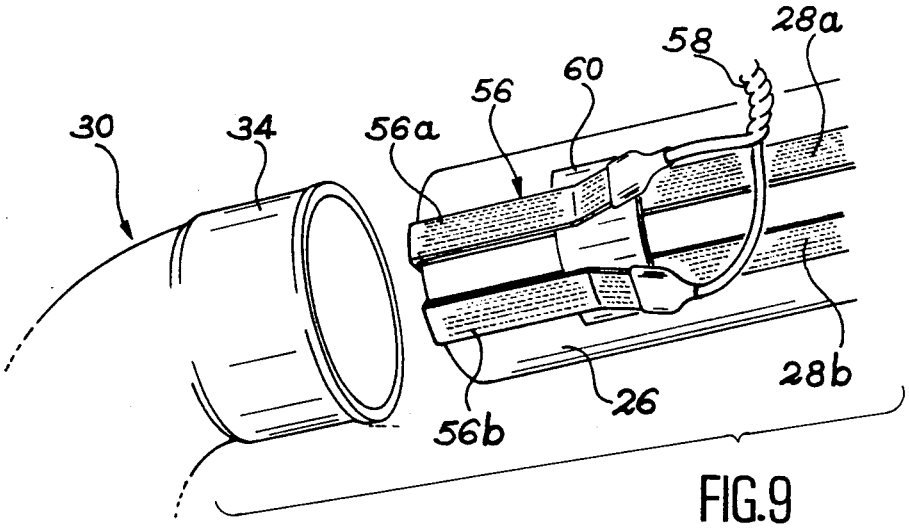
FIG. 9 a diagrammatic perspective view illustrating another connection means between a tube and a coupling using tongues in contact with the thin strip.

FIGS. 9 to 11 illustrate another connection mode between a tube and a coupling. It is once again possible to see coupling 30 having a cylindrical portion or socket 34 into which can be introduced one end of tube 26. However, in this case, there is no longer a conductive band on socket 34 and this is replaced by a group of elongated lamellas 56, whereof each is placed on the surface of the tube, in contact with the thin strips 28 (see FIGS. 2*a* and 2*b*). In the particular case illustrated in FIG. 9, the two strips 28*a*, 28*b* are longitudinally positioned along the tube and essentially juxtaposed, as in the case of FIG. 2*b*. The first lamella 56*a* is in contact with strip 28*a*, whilst the second lamella 56*b* is in contact with the second strip 28*b*. For reasons of convenience during the handling of the assembly, the two lamellas 56 can be integral with a support plate 60, which is e.g. made from plastic. As a function of the number of sockets of the coupling, the different arrangements shown in FIGS. 10*a* to 10*c* are used and they correspond to the same applications as the arrangements illustrated in FIGS. 8*a* to 8*c*.

In the case of FIG. 10*a*, there is only one group or assembly of two lamellas 56*a*, 56*b* mounted on a plate 60 and connected by a group 58 of conductors to another part of the installation. In the case of FIG. 10*b*, there are two groups of two lamellas, namely 56*a*, 56*b* and 62*a*, 62*b* mounted on plates 60 and 64 respectively. Conductors 58 are arranged so as to connect lamella 56*a* to lamella 62*a* and lamella 56*b* to lamella 62*b* respectively. Finally, in the case of FIG. 10*c*, there are three groups of two lamellas, namely 56*a*–56*b*, 62*a*–62*b* and 66*a*–66*b* mounted on plates 60, 64 and 68 respectively. In this case, the various lamellas are connected by a group of conductors 59, shown in mixed line form in FIGS. 10*a* and 10*b*, arranged in such a way that each of the lamellas 56*a*, 56*b* is electrically connected to a lamella of group 62*a*, 62*b* and to a lamella of group 66*a*, 66*b*. For greater convenience as illustrated in FIGS. 10*c* and 11, each lamella can have at one of its ends a folded or bent part, like the bent part 67 provided at the end of lamellas 66*a* and 66*b*. This bent part bears on the terminal edge of tube 26 and prevents sliding of the lamella during the introduction of the tube into the socket of the coupling.

Figure 12:
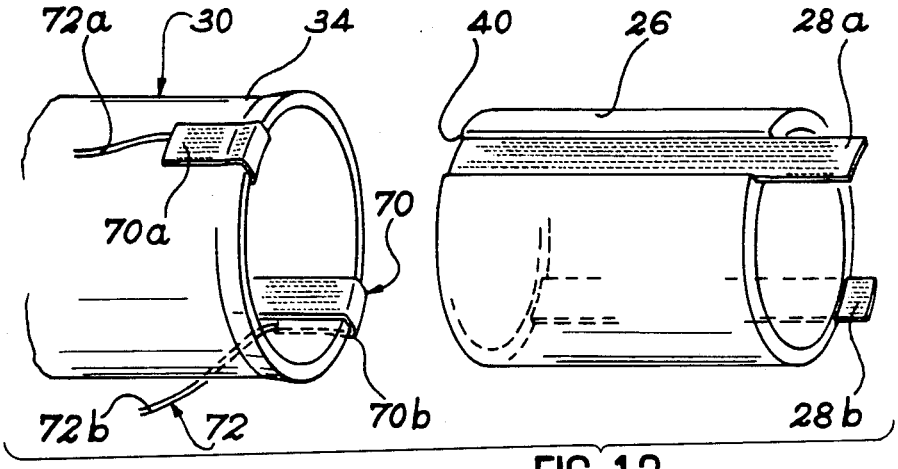
FIG. 12 a diagrammatic perspective view illustrating another connection mode between a tube and a coupling using a jumper or staple.

FIG. 12 illustrates another embodiment of the connection between a tube and a coupling. It is possible to see the cylindrical portion or socket 34 of coupling 30 intended to receive one end of tube 26. In this variant, the electrical connection between strips 28*a* and 28*b* of the tube and another part of the installation is ensured by means of two staples or jumpers 70*a*, 70*b*, whereof each overlaps the terminal edge of the coupling. Thus, part of each of the staples 70 is located within the cylindrical portion 34, whereas another part is located outside it. The arrangement of the staples is such that when the tube is introduced into socket 34, that part of each staple located inside the socket comes into contact by pressure against one of the two strips 28*a* or 28*b*. In this embodiment, in order to ensure a good relative orientation of the tube and the coupling and to prevent a subsequent relative sliding by rotation, it is preferable for strips 28*a* and 28*b* to be located in grooves 40 provided on the surface of the tube and as illustrated hereinbefore with reference to FIG. 6. For reasons of clarity, the depth of the groove 40 is exaggerated in FIG. 12 compared with the thickness of the tube, but said depth is generally approximately 1 mm.

Figure 14:
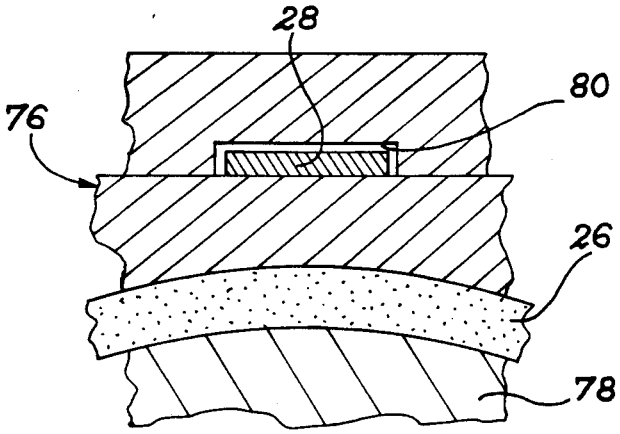
FIG. 14 a diagrammatic sectional view on a larger scale along line XIV—XIV of FIG. 13.
Figure 13:
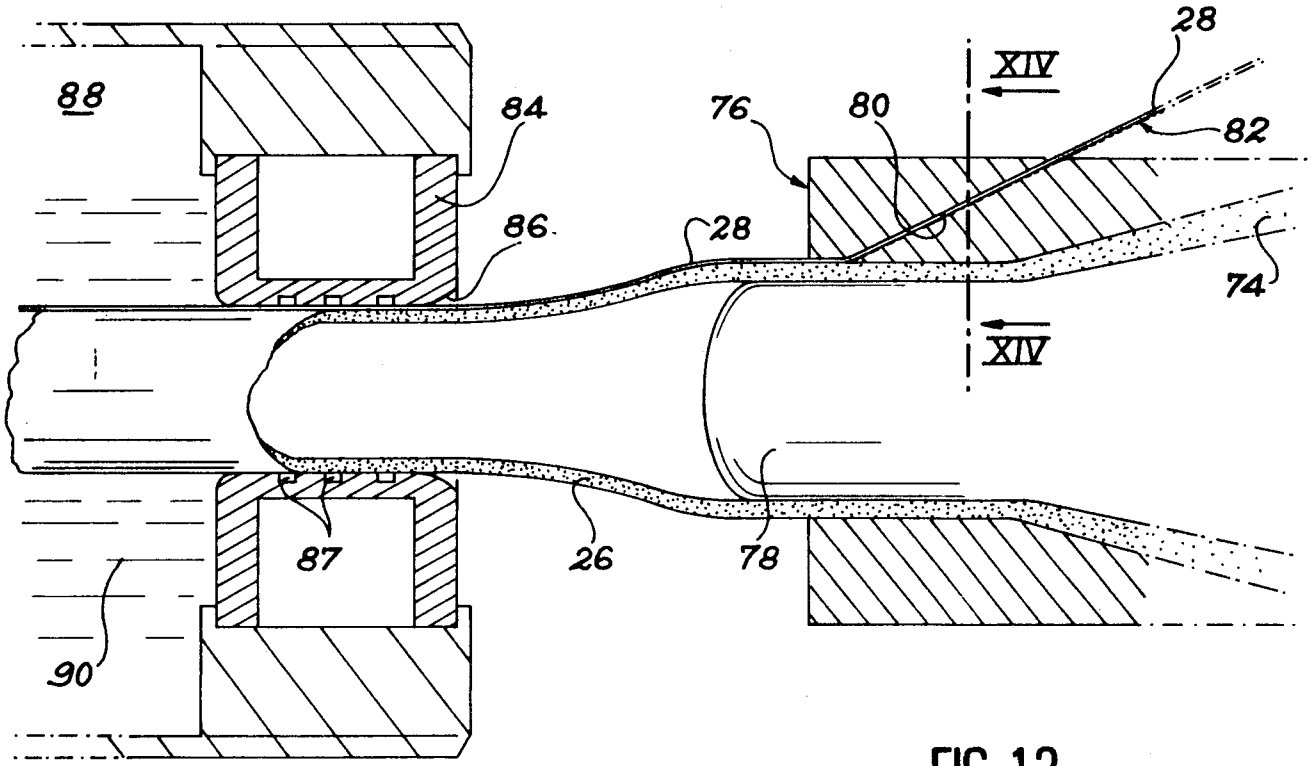
FIG. 13 a diagrammatic sectional view of an extrusion apparatus usable for producing a tube according to the invention.

A description will now be given of a preferred process for making a tube according to the invention with reference to FIGS. 13 and 14. It can be seen that the e.g. PVC tube can be produced in a conventional manner by extrusion from a blank 74, which is passed between a die 76 and a mandrel 78. Strip 28 is introduced into a slit 80 formed in the mass of die 76 and it passes out of said slit level with the die outlet, so that at said location it is in contact with the outer face of the tube. The width of slit 80 is substantially equal to that of strip 28 and the height is very small, so that the path of the strip along slit 80 leads to a heating thereof by friction. If necessary, the face of strip 28 which is to come into contact with the tube can be coated with an attachment layer 82, which can be of a PVC copolymer, when the tube is made from PVC and the strip from aluminum and heats sufficiently during the passage in slit 80 to permit an at least partial adhesion of the strip to the material from which the tube is formed due on the one hand to the heating resulting from the passage along the slit and on the other to the pressure exerted on leaving the die on the assembly constituted by the tube and the strip.

In order to permit on the one hand the final adhesion of the strip to the tube and on the other the shaping thereof to the final desired diameter, the tube leaving die 76 passes into a tube gauge 84, which has a cylindrical orifice 86, whose internal diameter is equal to the external diameter of the tube to be produced. This subsequent deformation of the tube is made possible by the fact that it is already in the plastic state on passing out of die 76. The inner walls of orifice 86 have cavities or pockets 87, which can be placed under a vacuum with the aid of a pump or any other adequate apparatus (not shown). This placing under vacuum has the effect of engaging the tube by suction against the walls of the orifice 86, because the interior of the tube remains filled with air. This engagement exerts a pressure, which has the effect of bringing the tube to the desired dimensions and of consolidating the adhesion of strip 28 to the tube. After being removed from orifice 86, the tube passes into a chamber 88, which is also under vacuum and which contains a body of water 90 for cooling the tube without breaking up the assembly constituted by the tube and the strip. Obviously, the arrangement of such an apparatus is adapted as a function of the number of strips to be fixed to the tube and the desired arrangement for them. For this purpose it is merely necessary to provide at appropriate points, one or more slits, like 80, in die 76.

FIGS. 15*a*, 15*b* and 16 show how the conductive band and the conductor provided on a coupling can be produced in one piece from a precut conductive band.

FIG. 15*a* is a perspective view similar to that of FIG. 3 showing a coupling 30 used for connecting two tubes 26, 27. However, the conductive bands at the end of the coupling and the conductor which connects them are made in one piece from a precut band shown in FIG. 15*b*. Said band, carrying the general reference 92, is constituted by three parts, namely a first rectilinear part 93*a*, a second rectilinear part 95, which is perpendicular to the first part and starts from one end thereof, and a third part 93*b* perpendicular to the second and starting from the end thereof opposite to the first part 93*a*. Once band 92 has been fixed to coupling 30 in the manner illustrated in FIG. 15*a* (part 95 on the outer face of the coupling and parts 93*a* and 93*b* on the inner faces of the cylindrical portions located at the ends of the coupling), bands 93*a* and 93*b* will serve the same function as bands 32 in FIG. 3 and part 95 will serve the same function as conductor 36 in FIG. 3.

In the case of FIG. 16*a*, coupling 30 comprises a rectilinear tubular part 31, on which is branched a second tubular part 33, whose axis forms a non-zero angle with that of part 31. Thus, it is possible to connect tube 26 on the one hand to tube 27 due to the part 31 of coupling 30 and on the other to a second tube 29 due to part 33 of said coupling.

FIG. 16*b* shows how, in this case, it is necessary to have two types of precut bands. A first band 92, similar to that of FIG. 15*a*, will be located along part 31, as described hereinafter. A second band 94 will be positioned along part 33 of coupling 30. Band 94 is essentially shaped like an L and has a first portion 97, which will have the same function as the hereinbefore described conductive bands 32 and a second portion 99, perpendicular to the first and which will have the same function as the conductors 36 connecting bands 32 to another part of the installation. In the case of FIG. 16*a*, portion 99 of band 94 is in electrical contact with part 95 of band 92 (e.g. by welding the two parts to one another).

As there are generally two thin strips on each tube, it is necessary to have two bands 92 for the coupling of FIG. 15*a*. For the coupling of FIG. 16*a*, it is necessary to have two bands such as 92 and two bands such as 94. The length of the different parts of these bands will be determined as a function of the dimensions of the couplings.

Preferably, bands such as 92 and 94 are coated on their face to be in contact with the coupling with an attachment layer, which can be of a PVC copolymer. The fitting to coupling 30 (FIG. 15*a*) firstly takes place by clipping one of the parts 93*a* or 93*b* in an adequate recess provided at one end of the coupling (in the aforementioned cylindrical portion). This is followed by the bending of part 95 and it is engaged on the outer face of the coupling. This is followed by a clipping of the other part 93*b* or 93*a* to the other end of the coupling. This is followed by the fixing of the band by bonding or heat sealing with the aid of the attachment layer. The process is the same for placing band 92 on part 31 of coupling 30 of FIG. 16*a*. Portions 97 and 99 of band 94 are fixed like one of the parts 93 and part 95 of band 92 respectively. In this case, the reliability of electric contact can be improved by forcibly interposing a metal lug or thin tongue between the conductive bands of the couplings and the thin strips of the tubes during the bonding of the tubes to the couplings.

Thus, the pipe system for a centralized suction cleaning installation according to the invention has particularly interesting advantages. Thus, due to the fact that the conductors are in the form of thin strips deposited on tubes, the overall dimensions of said installation are reduced and the handling of the tubes during fitting is facilitated, because the thin strip adapts to the shape of the tube. Moreover, the adhesion of the strip to the tube is good as a result of the above-described process with, in the case of metal strips, the use of an attachment layer, which aids said adhesion during the extrusion operation. Moreover, the contact surface of the conductor is larger than in the prior art and in particular larger than in U.S. 3,465,111. Electric contact between a tube and a coupling can be brought about in a more reliable manner because there is no risk of the conductor being damaged during the stripping operation. The possible protective film covering the strip is preferably of a material which dissolves in the glue used for bringing about sealing between tube and coupling at the time of their assembly. Finally, in the variants where the strip is slightly embedded in a groove provided on the tube surface, the protection of the strip is improved, whilst facilitating the introduction of the tube into a coupling when using a lamella or tongue for ensuring a better electric contact. Such tubes or couplings are inexpensive to manufacture, because they can be manufactured in a simple and rapid manner in view of the simplicity of the shapes used.

Obviously the invention is not limited to the embodiments described hereinbefore and numerous variants are possible thereto without passing beyond the scope of the invention, particularly with regards to the material from which the tubes, couplings and various conductors are made, as well as the arrangement and fixing means with respect thereto.

Moreover, although in the preferred embodiment, the strips are located outside the tubes and the conductive bands inside the sockets of the couplings, it would not pass outside the invention to place the strips within the tubes and the bands outside the couplings. In this case it would be necessary to adapt the diameters so that the socket of the coupling could be introduced into the tube.

What is claimed is:

1. A pipe system for a central suction cleaning installation for connecting a suction station to at least one suction opening, said pipe system having at least one tube made from plastic and equipped with at least one electric conductor of low voltage capability for the transmission of an electric control signal from the suction station, said pipe system having at least one coupling wherein said electric conductor is in the form of a first thin metallic strip made from an electrically conductive material and which is integral with the tube, said coupling having at least one cylindrical socketlike portion with dimensions enabling the tube and said cylindrical portion to be fitted together, one into the other, and electric connection means connected between the first thin strip and another part of the installation, wherein the electrical connection means comprise a conductive band in the form of a second thin metallic strip made from an electrically conductive material, said conductive band extending over part of the periphery of said cylindrical socketlike portion, whereby the arrangement of the first thin strip and conductive band constituted by the second thin strip is such that by fitting together, one into the other, the tube and cylindrical socketlike portion, said first strip can be made to face and engage the second strip and a conductor can be electrically connected to the conductive band and to said other part of the installation, said first and second strips being formed of flexible material of substantially similar dimensions.

2. A pipe system according to claim 1, wherein the conductor is in the form of a thin strip integral with the coupling and having one end in contact with said conductive band.

3. A pipe system according to claim 2, wherein the conductive band and thin strip are made in one piece from a precut conductive band fixed to the coupling.

4. A pipe system according to claim 1, wherein the conductor is a unifilar conductor.

5. A pipe system according to claim 1, wherein the dimensions of the tube and the cylindrical socketlike portion are such that by simply fitting together, one into the other the strip can be brought into electrical contact with the conductive band.

6. A pipe system for a central suction cleaning installation for connecting a suction station to at least one suction opening, said pipe system having at least one tube made from plastic and equipped with at least one electric conductor of low voltage capability for the transmission of an electric control signal from the suction station, said pipe system having at least one coupling, wherein said electric conductor is in the form of a thin metallic strip made from an electrically conductive material and which is integral with the tube, said coupling having at least one cylindrical socketlike portion with dimensions enabling the tube and said cylindrical portion to be fitted together, one into the other, and electric connection means connected between the thin strip and another part of the said installation, the electrical connection comprising a conductive band extending over part of the periphery of said cylindrical socketlike portion, whereby the arrangement of the thin strip and conductive band is such that by fitting together the tube and cylindrical socketlike portion, said strip can be made to face and engage the conductive band and a conductor can be electrically connected to the conductive band and to said other part of the installation, said system including a tongue made from an electrically conductive material to be forcibly introduced between the thin strip and the conductive band, in order to ensure the electric contact between said tube and cylindrical portion when the tube and the cylindrical socketlike portion of the coupling are fitted together, one into the other.

7. A pipe system according to claim 6, wherein the thin strip has a first face in contact with one wall of the tube and a second face covered with a protective layer of an electrically insulating material.

8. A pipe system for a central suction cleaning installation for connecting a suction station to at least one suction opening, said pipe system having at least one tube made from plastic and equipped with at least one electric conductor of low voltage capability for the transmission of an electric control signal from the suction station, said pipe system having at least one coupling, wherein said electric conductor is in the form of a thin metallic strip made from an electrically conductive material and which is integral with the tube, said coupling having at least one cylindrical socketlike portion with dimensions enabling the tube and said cylindrical portion to be fitted together, one into the other, and electric connection means connected between the thin strip and another part of the said installation, the electrical connection means comprising a tongue made from an electrically conductive material, which can be forcibly introduced between the tube and the cylindrical socketlike portion of the coupling, when said members are fitted into one another, so as to be in contact with said thin strip and a conductor which can be electrically connected to said tongue and to said other part of the installation.

9. A pipe system according to claim 8, wherein said tongue has an end with a bent part, which can engage on a terminal edge of the tube or said cylindrical socketlike portion of the coupling.

10. A pipe system for a central suction cleaning installation for connecting a suction station to at least one suction opening, said pipe system having at least one tube made from plastic and equipped with at least one electric conductor of low voltage capability for the transmission of an electric control signal from the suction station, said pipe system having at least one coupling, wherein said electric conductor is in the form of a thin metallic strip made from an electrically conductive material and which is integral with the tube, said coupling having at least one cylindrical socketlike portion with dimensions enabling the tube and said cylindrical portion to be fitted together, one into the other, and electric connection means connected between the thin strip and another part of the said installation, the electrical connection means comprising a jumper able to overlap one terminal edge of the tube or said cylindrical socketlike portion of the coupling, one portion of said jumper being contactable with the thin strip when the tube and the cylindrical socketlike portion are introduced into one another and a conductor which can be electrically connected to said jumper and to said other part of the installation.

* * * * *